US011525331B1

(12) United States Patent
Schmidt et al.

(10) Patent No.: US 11,525,331 B1
(45) Date of Patent: Dec. 13, 2022

(54) SYSTEM AND METHOD FOR ESTABLISHING A BYPASS FLOW PATH WITHIN A WELLBORE LINER

(71) Applicants: Daniel Schmidt, Magnolia, TX (US); Todd Stair, Conroe, TX (US)

(72) Inventors: Daniel Schmidt, Magnolia, TX (US); Todd Stair, Conroe, TX (US)

(73) Assignee: Citadel Casing Solutions LLC, Houston, TX (US)

( * ) Notice: Subject to any disclaimer, the term of this patent is extended or adjusted under 35 U.S.C. 154(b) by 0 days.

(21) Appl. No.: 17/592,219

(22) Filed: Feb. 3, 2022

(51) Int. Cl.
*E21B 33/14* (2006.01)
*E21B 33/12* (2006.01)
*E21B 33/16* (2006.01)

(52) U.S. Cl.
CPC ..... *E21B 33/14* (2013.01); *E21B 33/12* (2013.01); *E21B 33/16* (2013.01)

(58) Field of Classification Search
CPC ..... E21B 33/14; E21B 33/12; E21B 33/16; E21B 33/165
See application file for complete search history.

(56) References Cited

U.S. PATENT DOCUMENTS

| | | | | |
|---|---|---|---|---|
| 9,297,230 | B2 * | 3/2016 | Stair | E21B 33/14 |
| 10,767,440 | B2 * | 9/2020 | Stair | E21B 33/16 |
| 2008/0251253 | A1 * | 10/2008 | Lumbye | E21B 33/16 166/317 |
| 2015/0136395 | A1 * | 5/2015 | Turley | E21B 33/134 166/65.1 |

* cited by examiner

*Primary Examiner* — Michael R Wills, III
(74) *Attorney, Agent, or Firm* — Leavitt Eldredge Law Firm

(57) ABSTRACT

A system for establishing a bypass flow path includes a plug assembly having bypass ports extending from the exterior to the interior; a wiper dart to engage and seal the first flow path and bypass flow path, and initiate release of the plug assembly from a first position, the plug assembly having a dart nose attached to the dart body; once the plug has moved to a second position, pressure applied through the bypass ports communicates to the dart nose to cause detachment of the dart nose from the dart body; a first flow path extends through the central bore of the plug assembly when the wiper dart is not present; and a second flow path extends through the bypass ports on the plug assembly below the dart body to the detachable dart nose, once detached, the bypass flow path is established thru the bore below the dart body.

4 Claims, 10 Drawing Sheets

SYSTEM AND METHOD FOR ESTABLISHING A BYPASS FLOW PATH WITHIN A WELLBORE LINER

BACKGROUND

1. Field of the Invention

The present invention relates generally to wellbore operation systems, and more specifically, to a system and method for establishing an alternate flow path after a liner wiper plug assembly has completed wiping of a liner and has landed into a landing seat at a lower end of the liner.

2. Description of Related Art

Wellbore operation systems are well known in the art and are effective means to collect resources for energy use. FIG. 1 depicts a flowchart 101 of a conventional method, further explained herein. In the conventional operation:

103: First, a parent casing string of a given size is cemented at a certain depth within a wellbore.

105: Next, a drilled section is created below a lower end of the parent casing string into which a liner of a smaller diameter (compared to the parent casing string) is run to a depth below the parent casing on a landing or work string. This creates an annulus between the outer diameter of the liner and the drilled hole below the parent casing.

107: The liner is run by attaching an upper end of the liner to a liner hanger tool. The liner hanger tool is used to mechanically hang the liner into the parent casing string.

109: A liner plug assembly for wiping out cement is attached to a bottom of the liner hanger.

111: Next, during pressure pumping operations, cement is pumped from the surface, through the landing string, liner and into the annulus. This is followed by a wiper dart, which is further followed by displacement fluid. The wiper dart displaces the cement through the work string and is displaced until the wiper dart nose lands into and engages with the liner plug assembly.

113: The wiper dart nose lands into and engages with the liner plug assembly via mechanically latching into and sealing within a releasing sleeve of the liner plug assembly.

115: Pressure is then applied above the latched wiper dart, which initiates the release of the liner plug assembly from the liner hanger running tool.

117: The liner wiper plug and wiper dart are displaced down the liner to push cement through the liner and into the annulus.

119: Next, in a conventional operation, the liner wiper plug and wiper dart together displace cement until the liner wiper plug and wiper dart reach the landing seat near the end of the liner.

121: For a well utilizing a wet shoe cementing method, once the liner wiper plug and wiper dart have reached the landing seat, an alternate flow path is established with increased pressure applied on top of the liner wiper plug and wiper dart and the cement is then displaced through the shoe track and completely out of the liner, thereby allowing for the operator to maintain flow through the liner after cement cures.

The present invention provides for a wiper dart with a releasable nose to provide for an alternative flow path.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
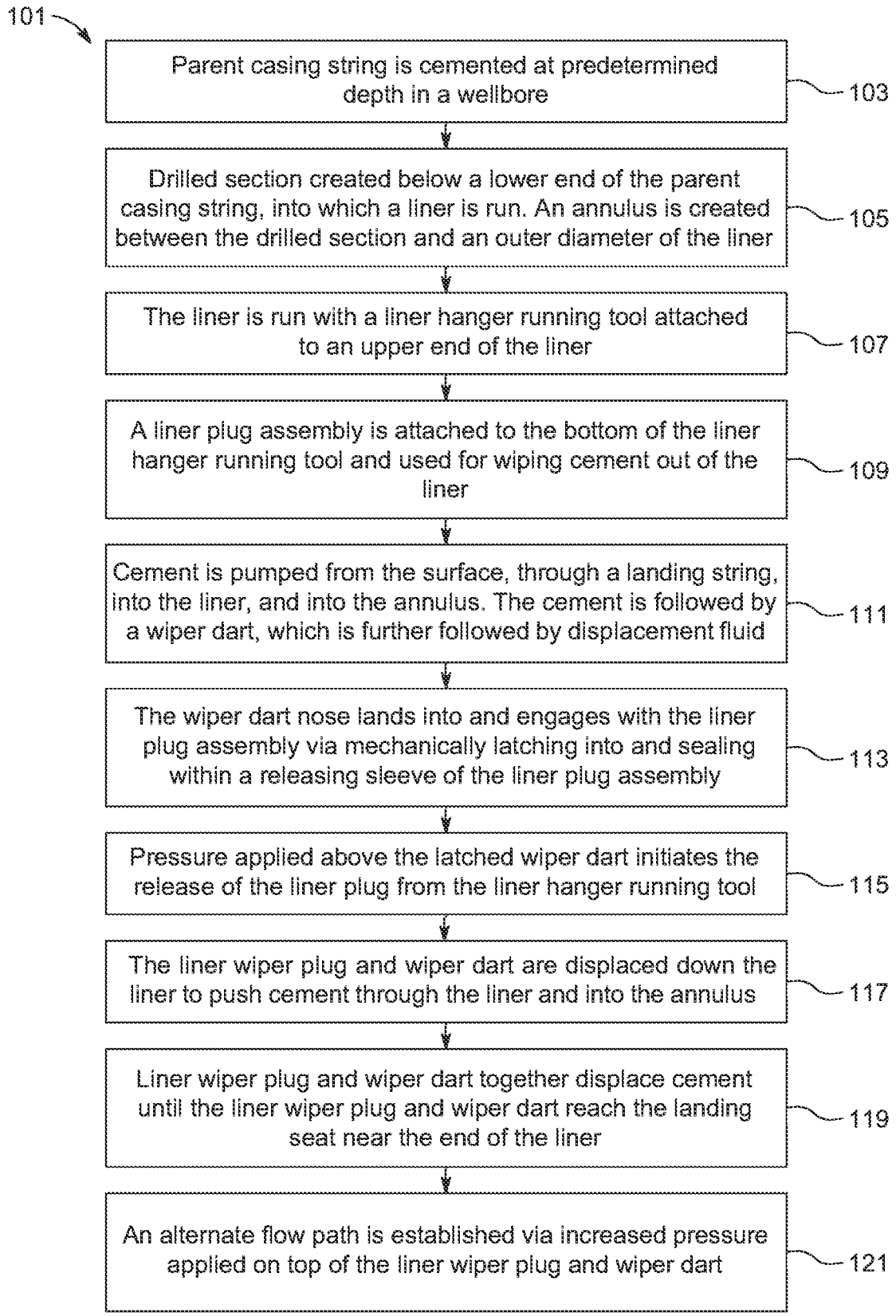
FIG. 1 (Prior Art)
FIG. 1 is a flowchart of a conventional wellbore operation system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
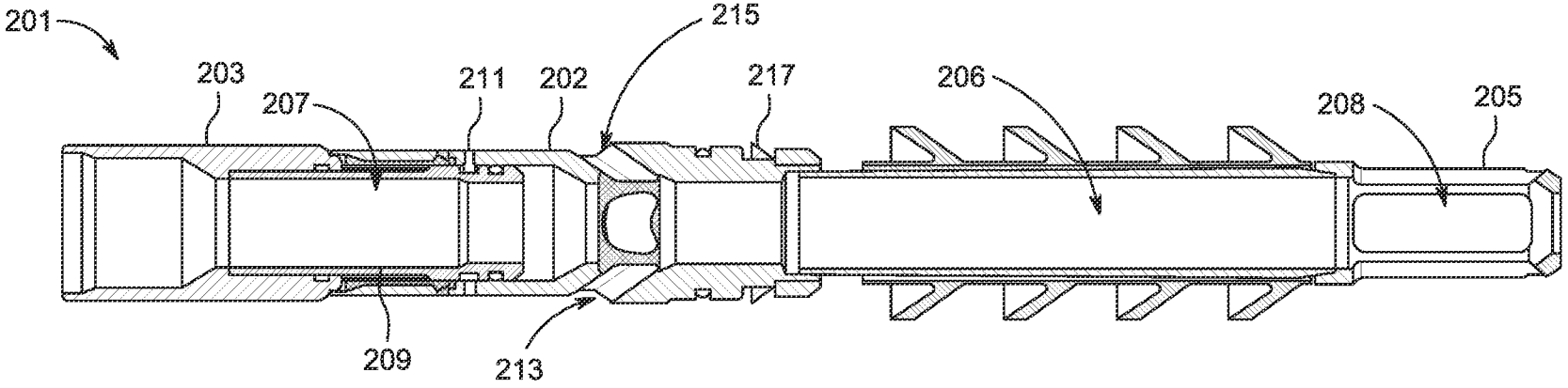
FIG. 2 is a side view of a liner wiper plug assembly in accordance with the present invention.

Referring now to the drawings wherein like reference characters identify corresponding or similar elements throughout the several views, FIG. 2 depicts a side view of a liner wiper plug assembly 201 in accordance with a preferred embodiment of the present application.

Figure 7:
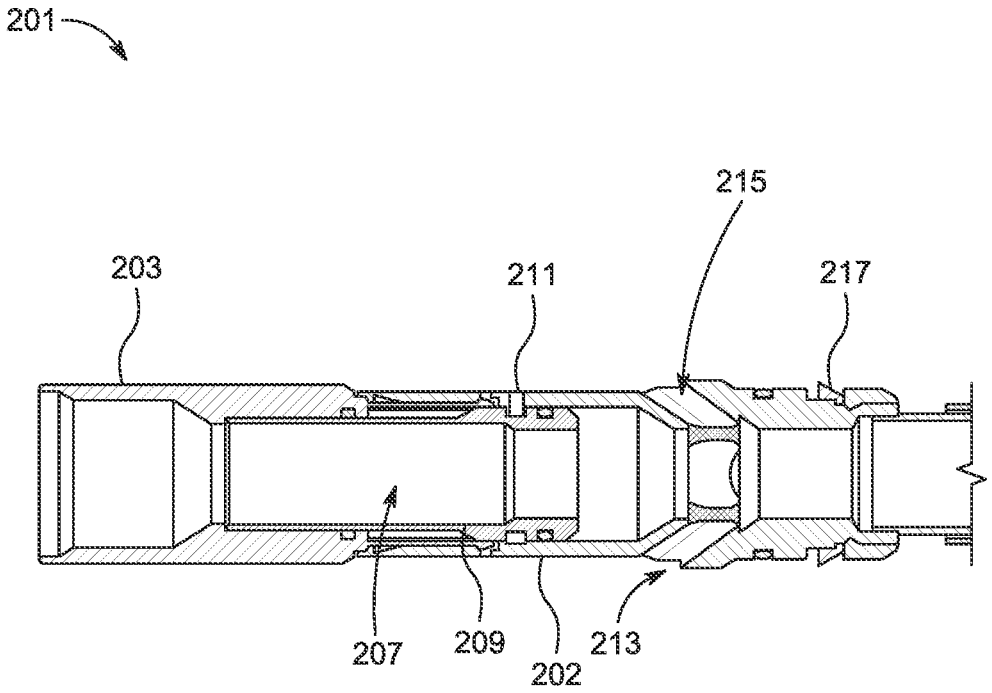
FIG. 7 is a side partial view of the liner wiper plug assembly of FIG. 2 showing details of the assembly.

As best shown in FIGS. 2 and 7, assembly 201 includes a plug body 202, connected to a liner hanger running tool via a collet 203 with a threaded connection, the connection at a first end and a nose 205 at a second end of the assembly 201. The assembly further includes an interior channel 207 created via a releasing sleeve 209, further extending to a bore 206 of the liner wiper plug assembly 201 and a liner plug catcher 208. In FIG. 2, it will be appreciated that the sleeve 209 is shown in a first position. Further, the assembly 201 includes a shear pin 211, bypass ports 213, 215, and a liner plug assembly latch 217 as will be discussed in more detail herein.

Figure 3:
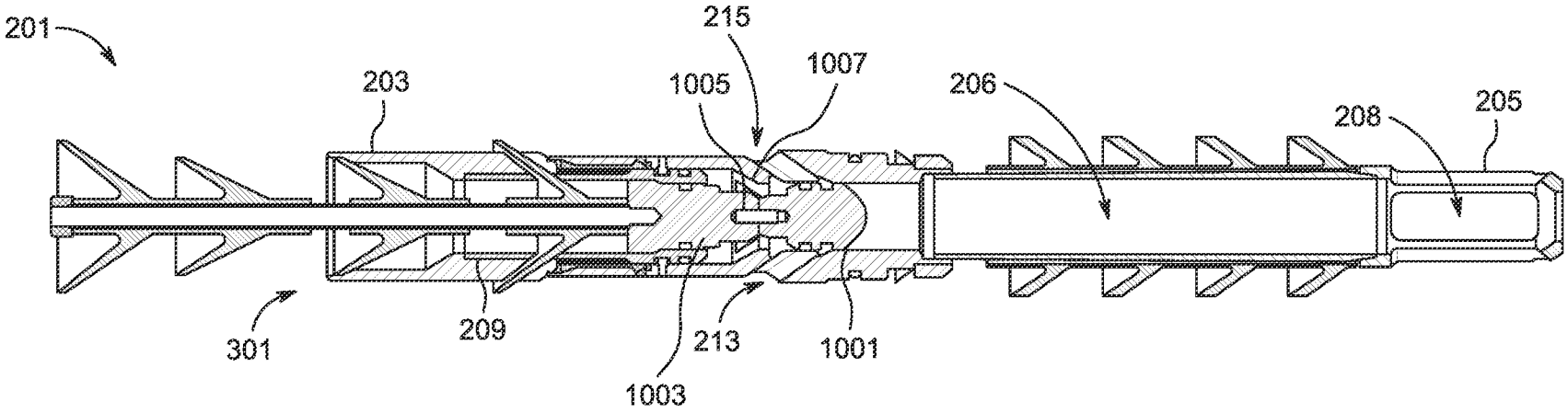
FIG. 3 is a side view of the liner wiper plug assembly of FIG. 2 with a wiper dart landed in the releasing sleeve in accordance with the present invention.

In FIG. 3, the liner wiper plug assembly from FIG. 2 is shown with a wiper dart 301. As shown, the wiper dart 301 lands within the releasing sleeve 209, the wiper dart 301 including wipers 303 that are configured to flex or bend as necessary to enter the releasing sleeve.

Figure 10:
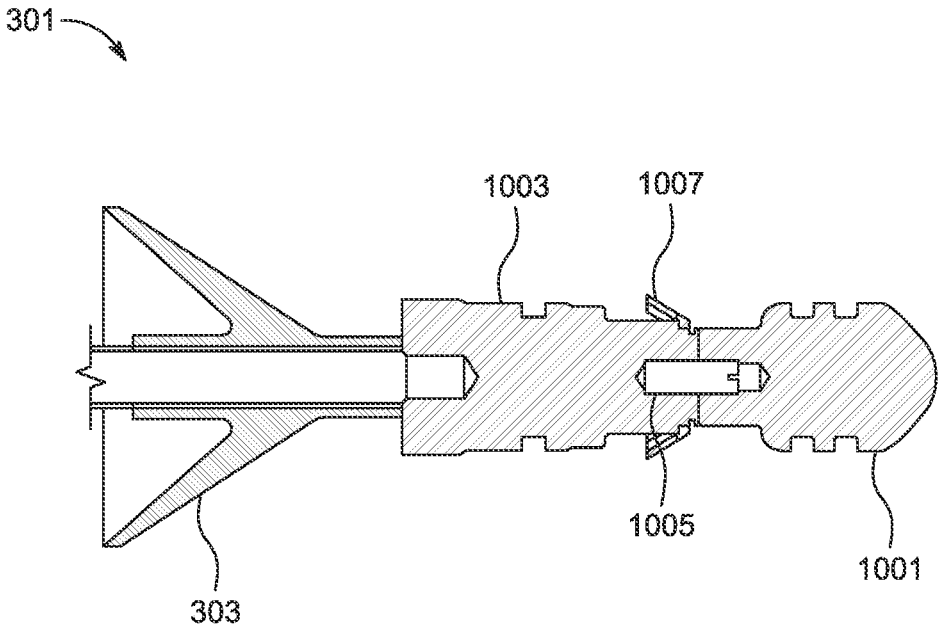
FIG. 10 is a side view of the wiper dart showing details of the wiper dart in accordance with the present invention.
Figure 11:
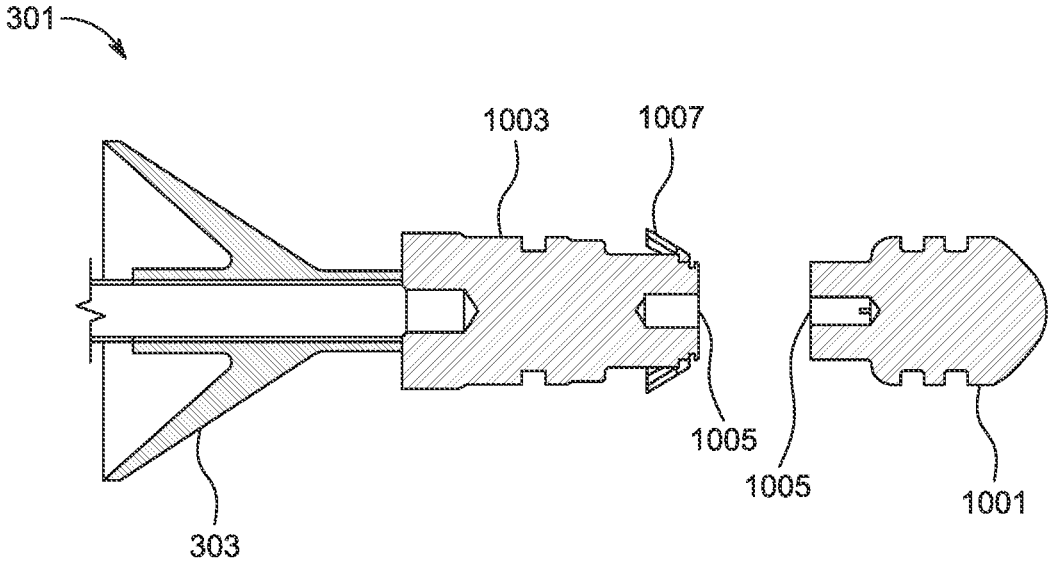
FIG. 11 is a side view of the wiper dart showing details of the disconnect of the nose in accordance with the present invention.

In FIGS. 10 and 11, additional details of the wiper dart 301 are shown. Wiper dart 301 including a dart nose 1001 attached to a wiper dart body 1003 via an axial shear stud 1005, the axial shear stud 1005 providing for a releasing mechanism between the nose 1001 and the body 1003. Further, as shown, a wiper dart latch mechanism 1007 is positioned at a seam between the dart nose 1001 and dart body 1003. Lastly, the wiper dart 301 includes the wipers 303 which may vary. As shown in FIG. 11, the nose 1001 is configured to detach from the body 1003 when a predetermined amount of pressure is applied as will be discussed below, this creates the bypass flow path as the nose 1001 will travel through the bore 206 to the catcher 208. This is a unique feature of the present invention.

Figure 4:
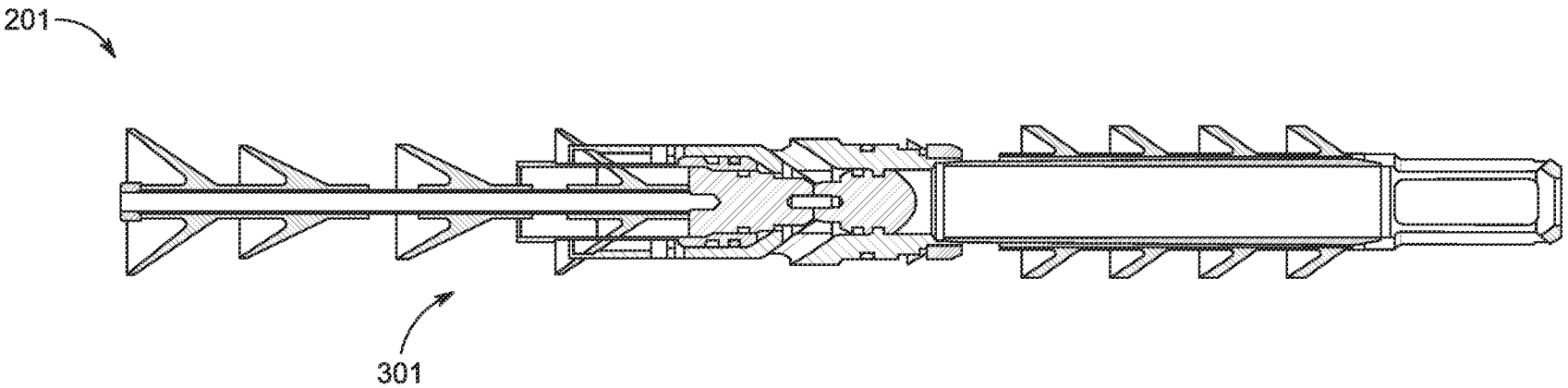
FIG. 4 is a side view of the liner wiper plug assembly of FIG. 2 with the wiper dart landed in the releasing sleeve, wherein the full assembly is released from a liner hanger running tool.

In FIG. 4, the liner wiper plug assembly 201 and wiper dart 301 are shown released from the collet 203 and liner hanger running tool. This configuration is displaced down the liner with cement ahead and displacement fluid behind. The liner wiper plug assembly is released from the collet based on a predetermined pressure, and the liner wiper plug assembly and wiper dart are displaced down the liner 503 until the assembly engages with the landing seat 501.

Figure 5:
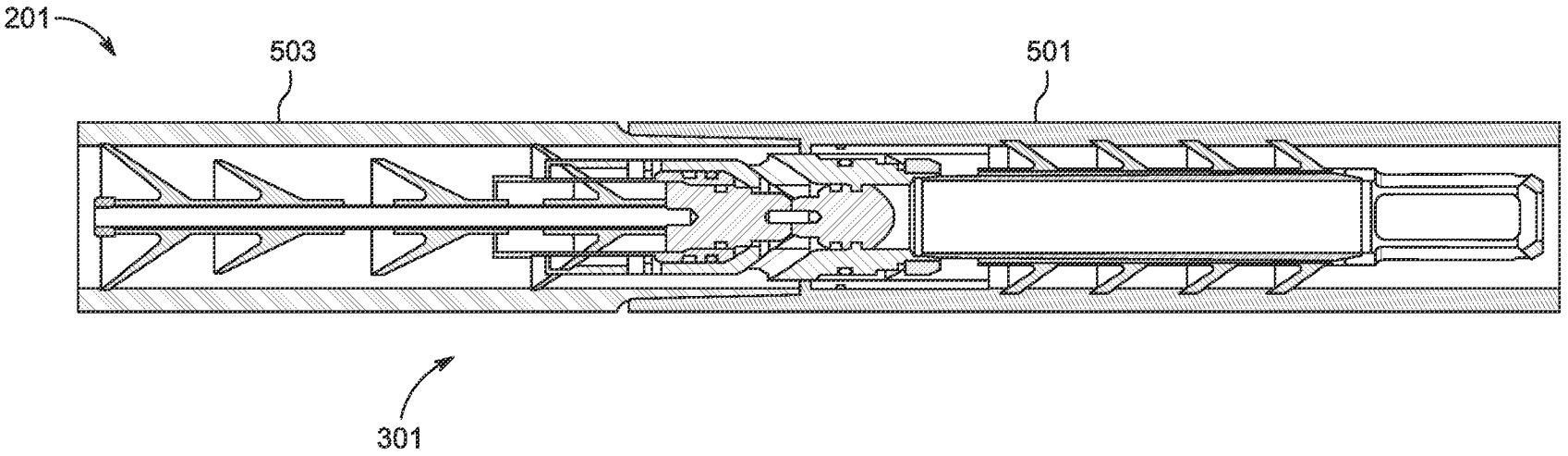
FIG. 5 is a side view of the liner wiper plug assembly of FIG. 2 with the wiper dart landed in the releasing sleeve, wherein the full assembly is shown within the liner of a wellbore operation.

In FIG. 5, the liner wiper plug assembly 201 and wiper dart 301 are shown once landed and seated into the landing seat 501. As shown, in this configuration, a seal is formed between the liner wiper plug assembly 201 as well as the wiper dart 301 and the landing seat. This allows for pressure to be increased in the liner 503 above the liner wiper plug assembly and wiper dart.

Figure 6:
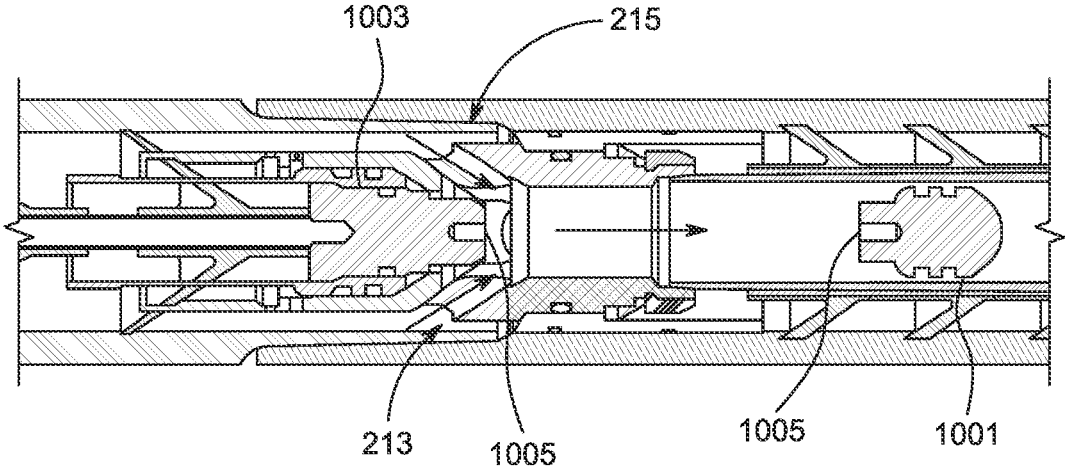
FIG. 6 is a side partial view of the liner wiper plug assembly of FIG. 2 with the wiper dart, showing an increase in pressure causing a nose of the wiper dart to disconnect.

In FIG. 6, the arrows indicate an increase in pressure communicated through the bypass ports 213, 215 and accordingly, a release of the wiper dart nose 1001 from the wiper dart body 1003 as the axial shear stud 1005 separates.

Figure 8:
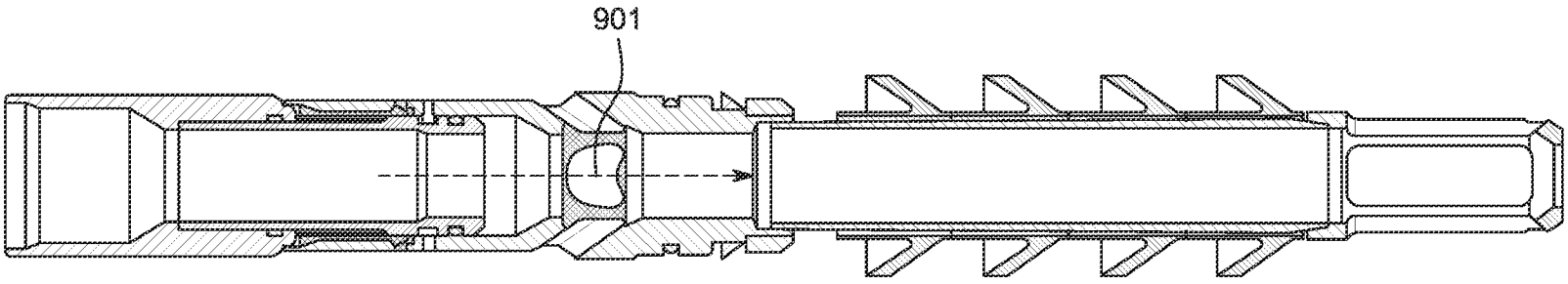
FIG. 8 is a side view of the liner wiper plug assembly of FIG. 2 showing a first flow path of the present invention.
Figure 9:
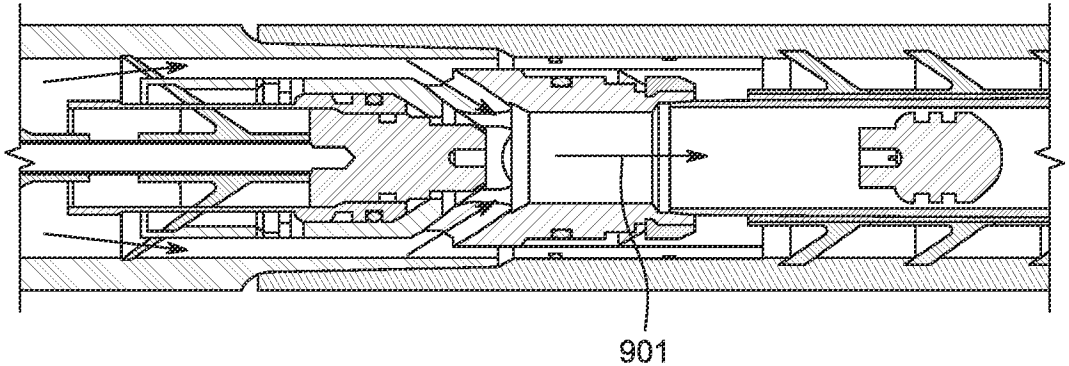
FIG. 9 is a partial side view of the liner wiper plug assembly of FIG. 2 with the wiper dart, showing details of the increase in pressure causing the nose of the wiper dart to disconnect.

For clarity, FIGS. 8 and 9 demonstrate a first flow path 801 and a second flow path 901.

Figure 12:
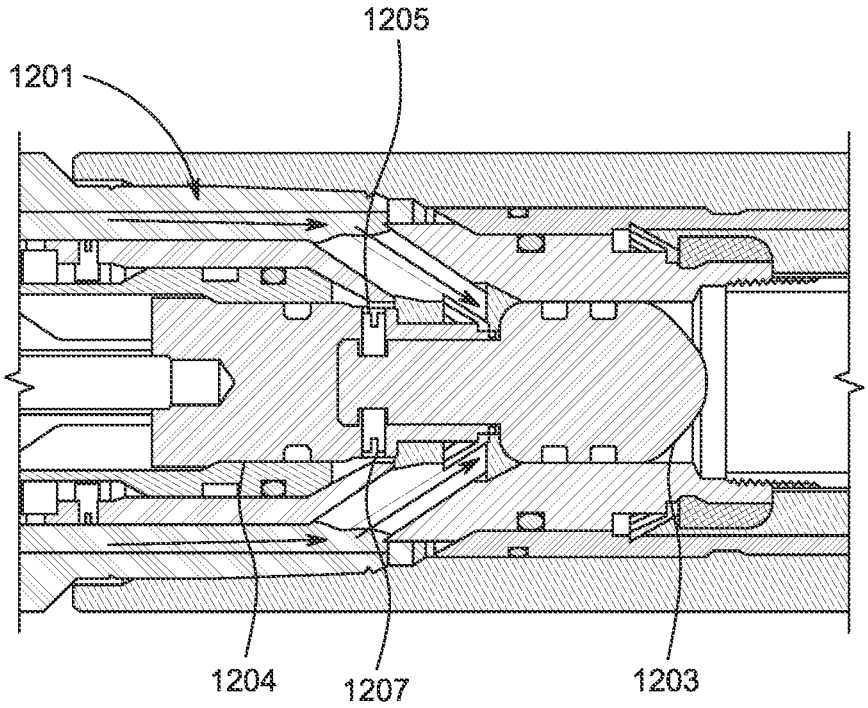
FIG. 12 is a partial side view of the liner wiper plug assembly of FIG. 2 with an alternative embodiment of a wiper dart in accordance with the present invention.

In FIG. 12, an alternative embodiment of a dart nose 1201 is shown. In this embodiment, a nose 1203 is secured to a body 1204 via radial pins 1205, 1207. As discussed above, the nose is released via pressure, as indicated with the arrows. The remaining function is the same as described above.

Figure 13:
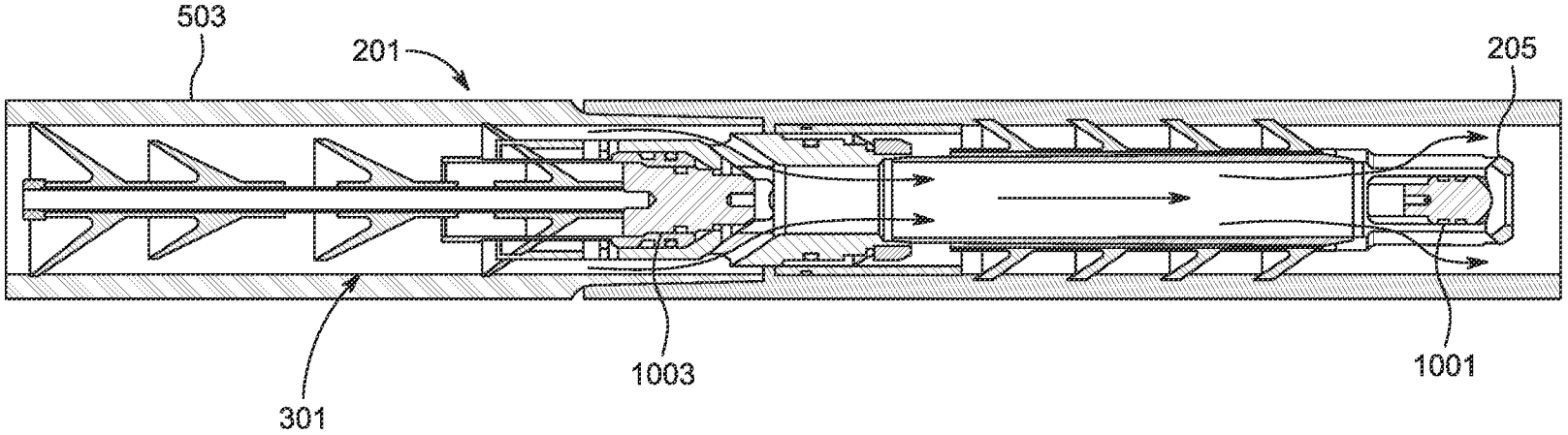
FIG. 13 is a side view of the liner wiper plug assembly of FIG. 2, with the wiper dart, wherein the dart nose is disconnected, thereby showing the alternate flow path of the present invention.

Lastly, as shown in FIG. 13, a flow path (represented by arrows) is shown associated with the assembly of the present invention, wherein the nose 1001 has separated.

It should be appreciated that one of the unique features believed characteristic of the present application is the configuration of the wiper dart 301, wherein the nose 1001 is releasable via pressure in combination with the bypass ports, thereby creating a fluid bypass that takes fluid past the primary landing and sealing features of the assembly. This creates a system having two fluid inflow routes, namely the first route for cement through the center of the assembly, and the alternate flow path that bypasses the first route that is blocked with the wiper dart nose.

The system has two positions, the first position is shown in FIG. 5 is a default and/or run-in hole position, and the second position, as shown in FIG. 6 is a shifted and/or released position.

It should be appreciated that the wiper dart lands in the first position (FIG. 5) of the system and permanently blocks the first flow path within the releasing sleeve and temporarily blocks the second or alternate flow path route. Once the liner plug assembly is released and pumped until landed on the landing seat in this embodiment, pressure can then be applied via the alternate flow path thru the bypass ports and applied to the wiper dart nose, such that separation occurs, as discussed above. The axial shear stud severs with a predetermined pressure and the dart nose shears out and is pumped thru the outflow route (bore) to be captured in the liner plug catcher. Flow is then established from the alternate flow path to the outflow route (which allows a wet shoe to be established in this embodiment).

Figure 14:
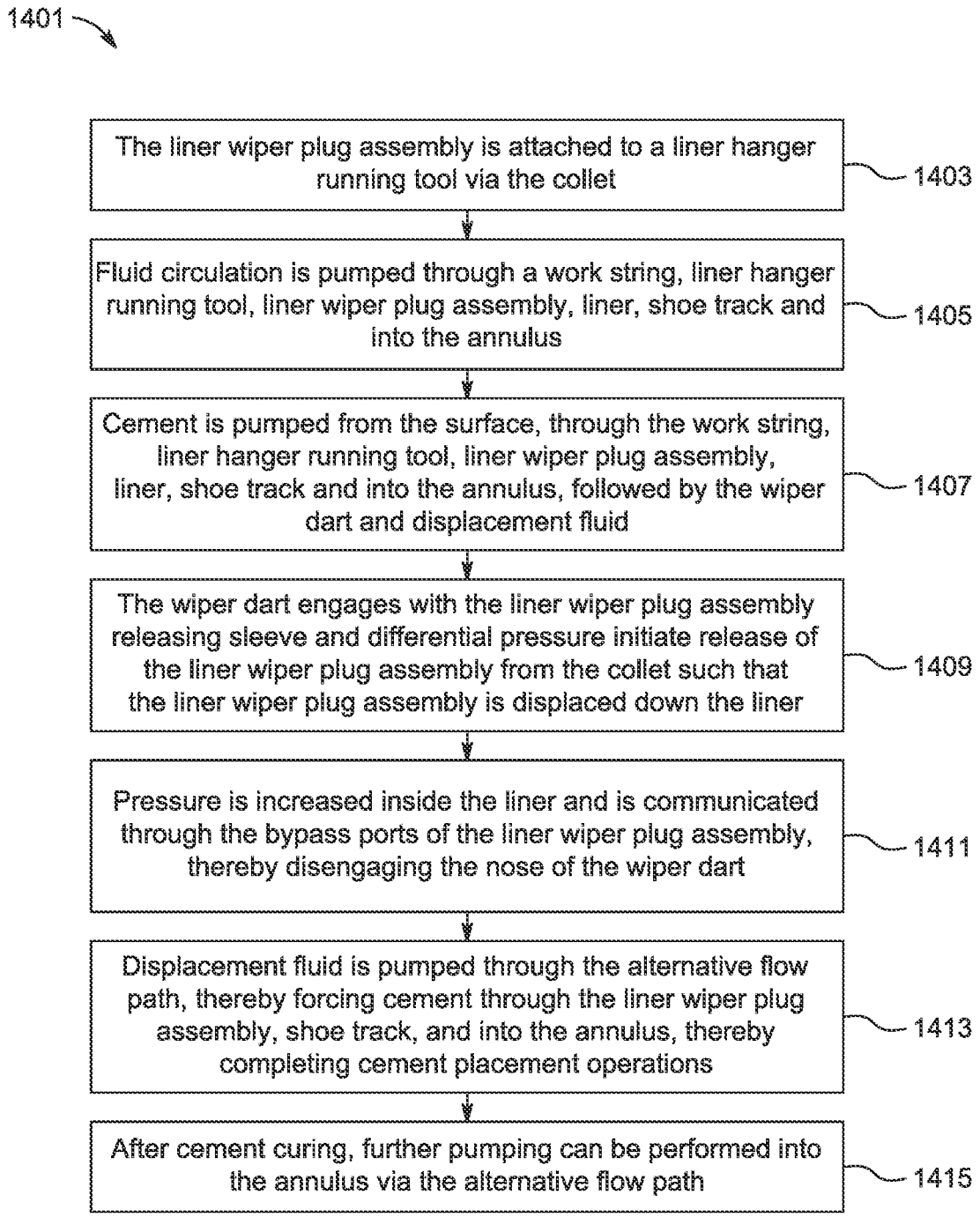
FIG. 14 is a flowchart of a method of operation in accordance with the present invention.

In FIG. 14, a flowchart 1401 depicts the method of operation of the present invention:

1403: First, the liner wiper plug assembly is attached to a liner hanger running tool (not shown) via a threaded connection on the collet. The plug components are held within the collet mechanism. 1405: Next, fluid circulation is pumped from the surface through the work string, the liner hanger running tool, the liner wiper plug assembly, the liner, the shoe track and into the annulus to prepare the annulus for cementing operations.

1407: Then, cement is pumped from the surface through the work string, the liner hanger running tool, the liner wiper plug assembly, the liner, the shoe track, and into the annulus to prepare the annulus. This is then followed by the wiper dart and displacement fluid.

1409: The wiper dart engages with the liner wiper plug assembly releasing sleeve and differential pressure initiates a release of the liner wiper plug assembly from the collet, thereby allowing the liner wiper plug assembly to be displaced down the liner until the assembly engages with the landing seat.

1411: Pressure is increased inside the liner and is communicated through the bypass ports of the liner wiper plug assembly, thereby causing the wiper dart nose to disengage from the wiper dart body. This is achieved once a predetermined pressure differential is applied, and the axial shear stud separates and releases the nose. The nose then moves through the bore of the liner wiper plug assembly to be caught in the liner plug catcher.

1413: Further pumping of displacement fluid through the alternate flow path forces the cement through the liner wiper plug assembly, the shoe track, and into the annulus thereby fully evacuating the liner of cement, completing cement placement operations.

1415: Once the cement cures, further pumping can be performed from the surface, through the liner and into the annulus via the alternate flow path created by the liner wiper plug assembly when operations are performed as described herein.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system for establishing a bypass flow path within a wellbore, the system comprising:

a plug assembly extending from a first end to a second end, the plug assembly configured to connect to a liner hanger running tool, the plug assembly further having:

a plug body;

one or more bypass ports extending from an exterior of the body into the plug body to below an engagement surface of a dart body; and a bore extending through a portion of the plug assembly;

a wiper dart configured to engage with the plug assembly and configured to be run with the plug assembly within the wellbore, the wiper dart having:

the dart body; and a dart nose attached to the dart body via an attachment device;

wherein pressure applied through the one or more bypass ports, when the plug and wiper dart have landed is in a landing seat within the wellbore, communicates to the dart nose to cause detachment of the dart nose from the dart body via a release of the attachment device;

wherein a first flow path extends through the plug assembly and the bore of the plug assembly when the wiper dart is not present; and wherein a second flow path extends through the one or more bypass ports below the dart body, then through the bore of the plug assembly, after a release of the dart nose.

2. The system of claim 1, wherein the attachment device is an axial shear stud.

3. The system of claim 1, wherein the attachment device is one or more radial pins.

4. A method of establishing a bypass flow path within a wellbore, the method comprising:

providing the system of claim 1;

pumping fluid through a work string, a running tool, the plug assembly, a liner, a shoe track, and into an annulus of the wellbore;

pumping cement from a ground surface, through the work string, the running tool, the plug assembly, the liner, the shoe track, and into the annulus;

pumping the wiper dart and an amount of displacement fluid into the wellbore, wherein the wiper dart engages with the releasing sleeve and differential pressure initiates a release of the plug assembly such that the plug assembly is displaced down the liner and into the landing seat;

increasing pressure inside of the liner, the pressure increase extending through the one or more bypass ports, thereby disengaging the dart nose from the dart body; and pumping displacement fluid through the wellbore such that the displacement fluid travels through a bypass flow path, forcing cement through the plug assembly, the shoe track, and into the annulus.

* * * * *